US009429389B1

(12) United States Patent
Brewer

(10) Patent No.: US 9,429,389 B1
(45) Date of Patent: Aug. 30, 2016

(54) MULTIFUNCTIONAL CASES WITH LOCKING MECHANISMS

(71) Applicant: Donald Brewer, Seatonville, IL (US)

(72) Inventor: Donald Brewer, Seatonville, IL (US)

( * ) Notice: Subject to any disclaimer, the term of this patent is extended or adjusted under 35 U.S.C. 154(b) by 0 days.

(21) Appl. No.: 14/812,896

(22) Filed: Jul. 29, 2015

Related U.S. Application Data

(60) Provisional application No. 62/031,041, filed on Jul. 30, 2014.

(51) Int. Cl.
*E05B 65/52* (2006.01)
*F41C 33/06* (2006.01)

(52) U.S. Cl.
CPC ..... *F41C 33/06* (2013.01); *E05B 65/52* (2013.01); *E05B 65/5223* (2013.01); *Y10T 70/5031* (2015.04); *Y10T 70/5558* (2015.04); *Y10T 70/5589* (2015.04); *Y10T 292/0968* (2015.04); *Y10T 292/0997* (2015.04); *Y10T 292/57* (2015.04); *Y10T 292/82* (2015.04)

(58) Field of Classification Search
CPC .... F41C 33/06; E05B 65/0075; E05B 65/52; E05B 65/5027; E05B 65/5215; E05B 65/5223; Y10T 70/5558; Y10T 70/5589; Y10T 70/5031; Y10T 292/57; Y10T 292/82; Y10T 292/858; Y10T 292/0961; Y10T 292/0962; Y10T 292/0968; Y10T 292/0969; Y10T 292/097; Y10T 292/0995; Y10T 292/0997
USPC ..... 70/63, 64–67, 158–173; 292/156, 157, 292/162–164, 174, 175, 347, 348, 350, 292/336.3
See application file for complete search history.

(56) References Cited

U.S. PATENT DOCUMENTS 123,657 A * 2/1872 Young ..... E05B 65/0864 292/175
198,094 A * 12/1877 Faircloth, Jr. ..... E05B 65/0864 292/174
413,245 A * 10/1889 Richmond ..... E05B 65/0864 232/42
459,676 A * 9/1891 Daniel ..... E05B 15/0053 292/156
541,930 A * 7/1895 Harper ..... E05B 15/0053 292/155
573,136 A * 12/1896 Cable ..... E05B 37/12 70/304
586,780 A * 7/1897 Petgen ..... E05B 37/12 70/304
716,397 A * 12/1902 Vom Eigen ..... E05B 65/0864 292/175
853,358 A * 5/1907 Hammar et al. ..... E05B 65/025 105/310.2
919,653 A * 4/1909 Thomas et al. ..... E05B 65/0864 292/175

(Continued)

*Primary Examiner* — Lloyd Gall
(74) *Attorney, Agent, or Firm* — Blakely, Sokoloff, Taylor & Zafman LLP

(57) ABSTRACT

Described herein is a multifunctional case that can be used for protecting and preventing unauthorized use of different types and sizes of objects, weapons, firearms, or other items. In one embodiment, the multifunctional case includes a first shell and a second shell that is coupled to the first shell. A locking mechanism is coupled to the first shell. An external handle (e.g., handle that is external to the multifunctional case) is coupled to the locking mechanism and causes the locking mechanism to lock and unlock the first and second shells of the multifunctional case based on movement of the handle. The multifunctional case is securely locked and unlocked with no external clips or latches.

18 Claims, 12 Drawing Sheets

(56) References Cited

U.S. PATENT DOCUMENTS 1,181,311 A * 5/1916 Huber et al. ..... E05B 65/0864 292/175
1,301,452 A * 4/1919 Kaufmann ..... E05B 65/025 292/162
1,401,882 A * 12/1921 Cozzo ..... E05B 17/0037 292/162
1,404,557 A * 1/1922 Stahl ..... A45C 13/10 292/175
1,462,657 A * 7/1923 Rainalter ..... B65D 55/12 16/258
1,488,301 A * 3/1924 Tueckmantel ..... A45C 13/06 70/66
1,553,339 A * 9/1925 Traumuller ..... E05C 3/14 220/DIG. 26
1,607,397 A * 11/1926 Grimm ..... E05B 65/52 70/66
1,674,221 A * 6/1928 Preen ..... E05D 13/06 292/150
1,702,621 A * 2/1929 Stelljes ..... E05B 65/5223 292/162
1,775,332 A * 9/1930 Traumuller ..... E05C 19/06 292/175
2,420,484 A * 5/1947 Karavia ..... E05B 37/00 70/312
2,599,105 A * 6/1952 Green ..... A45C 13/10 292/162
2,637,194 A * 5/1953 Pietri ..... E05B 37/12 150/110
3,677,196 A * 7/1972 Schuller ..... E05D 15/505 105/377.11
3,828,592 A * 8/1974 Horgan, Jr. ..... E05C 1/06 292/170
4,548,392 A 10/1985 Rickling
4,630,852 A * 12/1986 White ..... E05C 19/06 292/87
4,668,029 A * 5/1987 Maizlish ..... B60B 33/06 16/32
4,824,086 A 4/1989 Rickling
5,197,313 A 3/1993 Chandler et al.
5,235,830 A * 8/1993 Benge ..... E05B 63/244 292/148
5,511,711 A 4/1996 Kunz
5,558,027 A * 9/1996 Williams ..... B60B 33/06 109/45
5,662,219 A 9/1997 Tschudy et al.
5,850,796 A 12/1998 Cislo
5,887,730 A 3/1999 St. George
6,082,272 A * 7/2000 Adrain ..... A47C 17/86 109/51
6,095,575 A * 8/2000 Woods ..... D06F 9/14 292/163
6,099,047 A 8/2000 Reiff et al.
6,119,493 A 9/2000 Carter et al.
6,206,261 B1 3/2001 McCrary
6,256,922 B1 7/2001 Jones et al.
6,279,799 B1 8/2001 Horton
6,488,148 B1 * 12/2002 Woodson ..... B65D 25/10 206/1.5
6,570,501 B2 5/2003 Bushnell et al.
6,722,496 B2 4/2004 Gantert
6,792,643 B1 * 9/2004 Ponziani ..... B60S 1/08 15/250.3
7,004,365 B2 2/2006 Ingram
7,360,648 B1 4/2008 Blaschke
7,726,705 B2 * 6/2010 Kim ..... B60N 3/083 292/163
8,342,324 B2 1/2013 Debias
8,418,901 B2 4/2013 Stimmell
2007/0193479 A1 * 8/2007 Slaats ..... A47F 5/0018 108/53.1
2010/0212376 A1 * 8/2010 Wagh ..... E05B 67/383 70/159
2014/0116303 A1 * 5/2014 Mothersele ..... F41C 33/06 109/64

* cited by examiner

MULTIFUNCTIONAL CASES WITH LOCKING MECHANISMS

RELATED APPLICATIONS

This application claims the benefit of U.S. Provisional Application No. 62/031,041, filed on Jul. 30, 2014, the entire contents of which are hereby incorporated by reference.

TECHNICAL FIELD

Embodiments of the present invention relate to multifunctional cases with locking mechanisms (e.g., compression locking mechanisms).

BACKGROUND

Firearm (e.g., guns, rifles, etc.) cases protect firearms from physical damage, moisture, and unauthorized users. A typical gun case is formed of a rigid exterior material and a padded interior section for protecting the gun. The gun case includes external clips or latches that must be unlatched to open the case and then latched to close upper and lower sections of the gun case. The external clips or latches may not be sufficiently strong to prevent an unauthorized user from opening the gun case and the clips or latches require additional time and effort in opening or closing the case.

SUMMARY

Described herein is a multifunctional case that can be used for protecting and preventing unauthorized use of different types and sizes of objects, weapons, firearms, or other items. In one embodiment, the multifunctional case includes a first shell and a second shell that is coupled to the first shell. A locking mechanism is coupled to the first shell. An external handle (e.g., handle that is external to the multifunctional case) is coupled to the locking mechanism and causes the locking mechanism to lock and unlock the first and second shells of the multifunctional case based on movement of the handle. The multifunctional case is securely locked and unlocked with no external clips or latches.

BRIEF DESCRIPTION OF THE DRAWINGS

The present invention is illustrated by way of example, and not by way of limitation, in the figures of the accompanying drawings and in which.

DETAILED DESCRIPTION

Described herein is a multifunctional case that can be used for protecting and preventing unauthorized use of different types of fire arms, weapons, bows, knives, etc. In one embodiment, the multifunctional case includes a first shell and a second shell that is coupled to the first shell. A locking mechanism is coupled to the first shell. An external handle (e.g., handle that is external to the multifunctional case) is coupled to the locking mechanism and causes the locking mechanism to lock and unlock the first and second shells of the multifunctional case based on movement of the handle. The multifunctional case is securely locked and unlocked with no external clips or latches.

In the following description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

Figure 1:
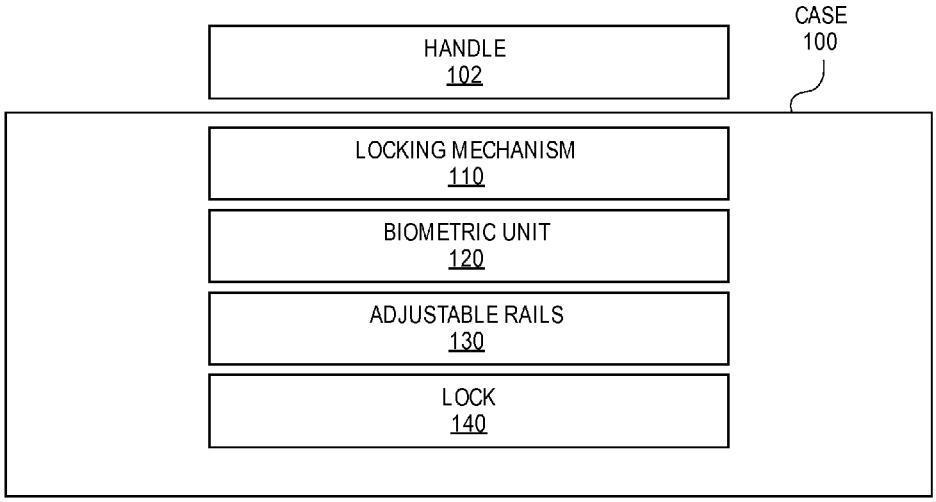
FIG. 1 illustrates a multifunctional case having a locking mechanism in accordance with one embodiment.

FIG. 1 illustrates a block diagram of a multifunctional case having a locking mechanism in accordance with one embodiment. The multifunctional case may be used for protecting different types of weapons (e.g., firearms, bows, knives, etc) and preventing the unauthorized use of these weapons. The case may also be used for storing and protecting camping or hunting gear. The multifunctional case 100 includes a locking mechanism 110 that is coupled to an external handle 102 and integrated with the handle via handle rods (not shown). A user can unlock upper and lower shells of the multifunctional case by moving the handle and causing the locking mechanism 110 to disengage. The user can then open the shells (e.g., upper and lower shells) of the case. An optional biometric unit 120 may receive a biometric input (e.g., fingerprint(s), retinal scan, etc.) from the user and then allow the locking mechanism to be unlocked if the biometric input matches a previously stored biometric input of an authorized user. Otherwise, if the biometric input does not match a previously stored biometric input, then the locking mechanism 110 remains locked. In another embodiment, a lock 140 (e.g., a haspless lock, a hidden shackle padlock, a rotary dial lock) may be integrated with the multifunctional case as an additional form of protection. The rotary dial lock may be inside the case with only the rotary dial being exposed for a user to access while the case is closed. The multifunctional case is rigid and resistant to many forces such as being forcibly opened by an unauthorized user and weather elements (e.g., water, snow, wind). The exterior of the multifunctional case may include rigid plastic, polymer, or metallic materials (e.g., aluminum) depending on a particular application. The interior of the case may including padding (e.g., foam padding). The interior of the case optionally includes adjustable clip rails 130 within the case for securing one or more objects, weapons, or gear within the case. The case includes no external clips or latches in contrast to conventional firearm cases. The case may optionally include a haspless lock or integrated rotary dial lock for additional security.

Figure 2:
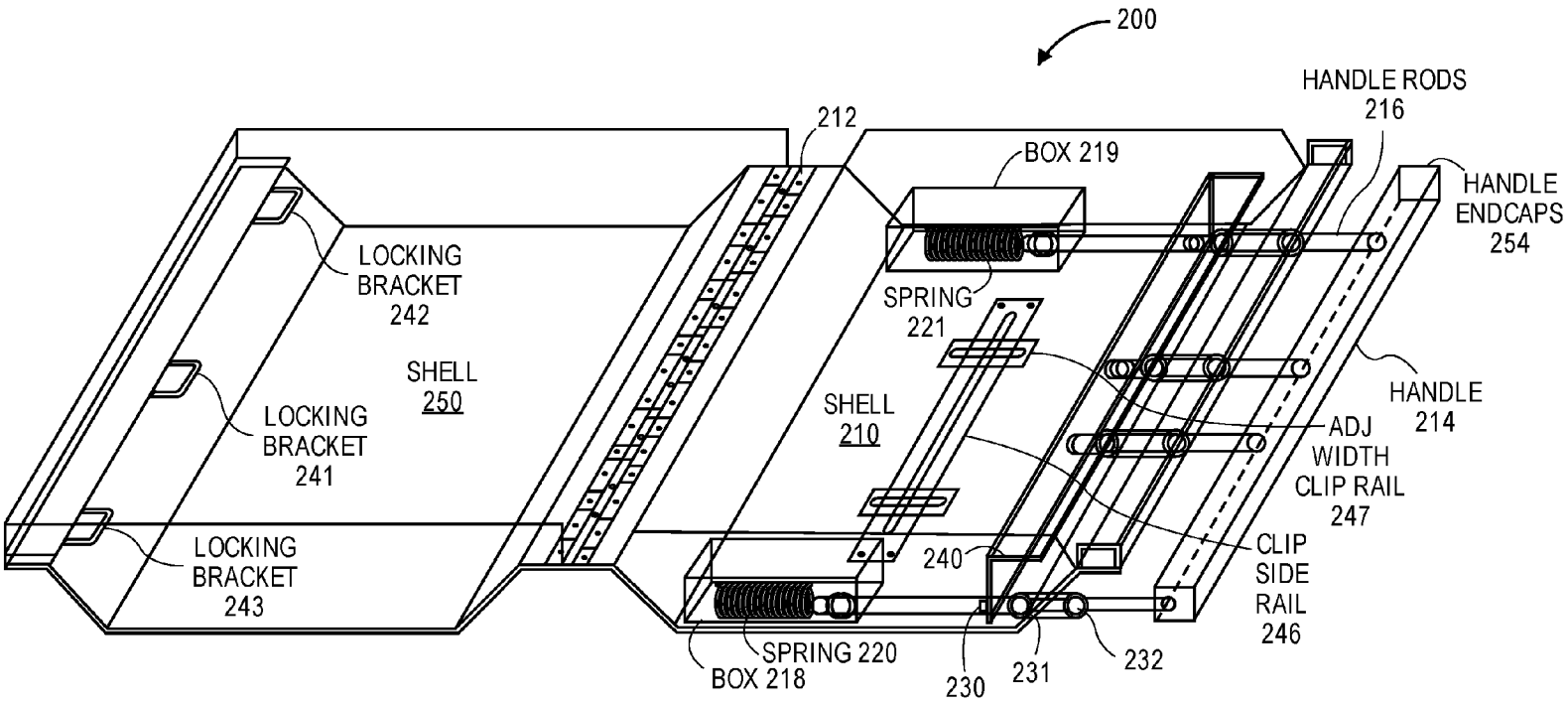
FIG. 2 illustrates an isometric view of a multifunctional case having a locking mechanism in accordance with one embodiment.

FIG. 2 illustrates an isometric view of a multifunctional case having a locking mechanism in accordance with one embodiment. The multifunctional case 200 includes a shell 210 (e.g., lower or bottom shell) and a shell 250 (e.g., upper or top shell) that are coupled with a hinge 212 (e.g., piano hinge). A handle 214 is mechanically coupled to handle rods 216, which are coupled to bushings 230, 231, 232 (e.g., set screw bushings) and springs 220 and 221. The springs are enclosed in boxes 218 and 219. A locking mechanism 240 (e.g., angle locking mechanism) moves based on movement of the handle towards a rear of the case near the hinge or away from a front of the case near the handle. The locking mechanism 240 engages with the locking brackets 241-243 to lock the shells 210 and 250 or the locking mechanism 240 disengages from the locking brackets 241-243 to unlock the shells 210 and 250 based on the movement of the handle 214. The shell 210 also includes a clip side rail 246 and an adjustable width clip rail 247 for securing different types and sizes of objects, weapons, firearms, or gear within the case. The handle in combination with the locking mechanism locks and unlocks the case such that the case does not need any external clips or latches. In another embodiment, the case also includes no padlocks or key locking devices for securely locking the case. The shells 210 and 250 are illustrated as having a hexagonal shape in general. In other embodiments, these shells may individually or in combination have any kind of geometrical shape including a polygon, a rectangular, a square, a quadrilateral, a pentagon, an octagon, etc. In one example, a lower shell includes a square or rectangular shape while an upper shell includes an octagonal shape or has radial symmetry. In another example, a lower shell has a partial octagonal shape while an upper shell has a square shape or has radial symmetry.

Figure 3:
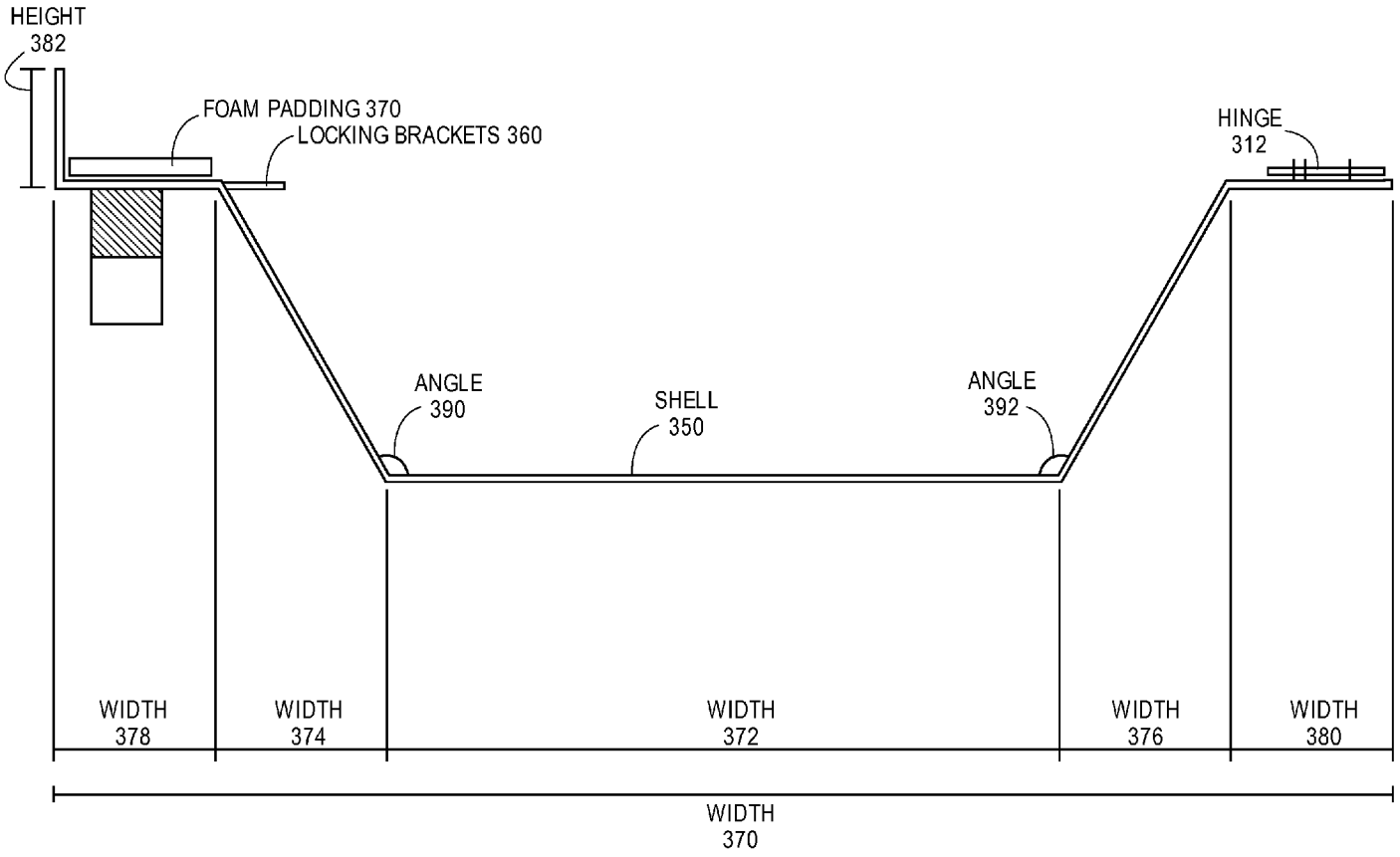
FIG. 3 illustrates a side view of a shell of a multifunctional case in accordance with one embodiment.

FIG. 3 illustrates a side view of a shell of a multifunctional case in accordance with one embodiment. The shell 350 (e.g., upper or top shell) includes similar components in comparison to the shell 250 of FIG. 2. The shell includes a hinge 212 (e.g., piano hinge) for being coupled with a shell 410 of FIG. 4. Locking bracket(s) 360 engage with an angle locking mechanism 440 of shell 410. The locking bracket(s) may be any type or shape for engaging with the angle locking mechanism 440. The shell 350 includes a foam padding 370. A lower portion of the shell 350 can have angles 390 and 392 or other angles such as right angles for forming a rectangular shell 350. The shell 350 includes a width 370 (e.g., 20-30 inches), a width 372 (e.g., 8-16 inches), widths 374, 376 (e.g., 3-5 inches), widths 378, 380 (e.g., 1-3 inches), and a height 382 (e.g., 0.5-1 inch) depending on a desired size of the multifunctional case. The shell 350 may also include adjustable weapon or firearm securement clip rails for securing different types and sizes of weapons, firearms, or other items (e.g., compound bow, hunting scope, flashlight, sleeping bag, thermal blanket, first aid kit, etc.) within the case. In alternative embodiments, the dimensions of the shell 350 are significantly smaller for smaller firearms (e.g., a hand gun).

Figure 4:
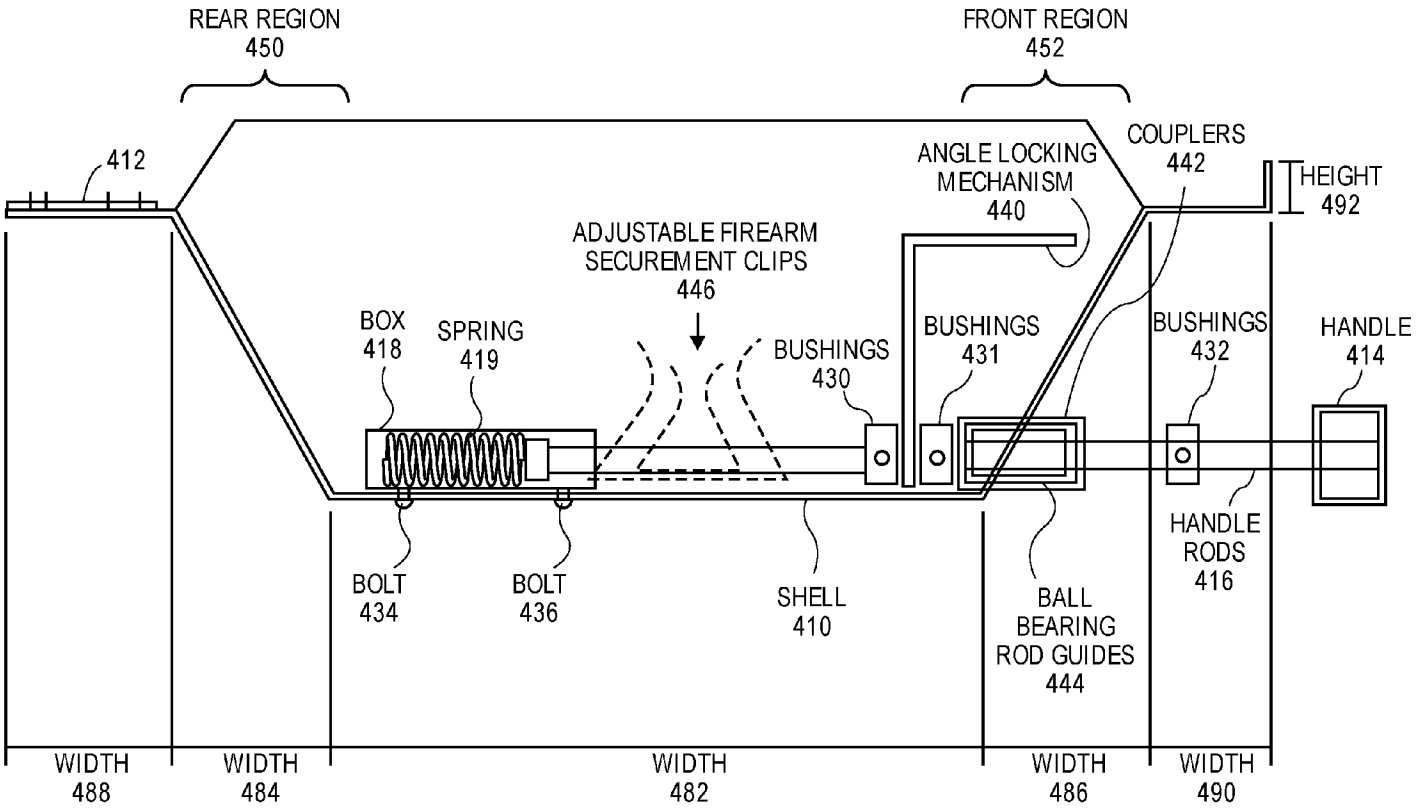
FIG. 4 illustrates a side view of a shell of a multifunctional case in accordance with one embodiment.

FIG. 4 illustrates a side view of a shell of a multifunctional case in accordance with one embodiment. The shell 410 (e.g., lower or bottom shell) includes similar components in comparison to the shell 210 of FIG. 2. The shell includes a hinge 412 (e.g., piano hinge) for being coupled with the shell 350 of FIG. 3. Locking bracket(s) 360 engage with an angle locking mechanism 440 of shell 410. A handle 414 is mechanically coupled to handle rods 416, which are coupled to bushings 430, 431, 432 (e.g., set screw bushings), couplers 442, optional ball bearing rod guides 444, and spring 419. The spring is enclosed in the box 418, which is attached to the shell 410 with carriage bolts 434 and 436. The shell 410 may include additional springs, boxes, locking brackets, bushings, couplers, and handle rods that are not shown in FIG. 4.

A locking mechanism 440 (e.g., angle locking mechanism) moves based on movement of the handle towards a rear region 450 of the case near the hinge or away from a front region 452 of the case near the ball bearing rod guides and couplers. The locking mechanism 440 engages with the locking bracket(s) 360 to lock the shells 410 and 350 or the locking mechanism disengages from the locking bracket(s) to unlock the shells based on the movement of the handle 414. The shell 410 also includes adjustable securement clips 446 for securing different types and sizes of objects, weapons, firearms, items, etc. within the case. A lower portion of the shell 350 can have obtuse angles as shown or other angles such as right angles for forming a rectangular shell 350. The shell 410 includes a width 482 (e.g., 8-16 inches), widths 484, 486 (e.g., 3-5 inches), widths 488, 490 (e.g., 1-3 inches), and a height 492 (e.g., 0.2-1 inch) depending on a desired size of a case. In alternative embodiments, the dimensions of the shell 410 are significantly smaller for smaller firearms (e.g., a hand gun).

Figure 5:
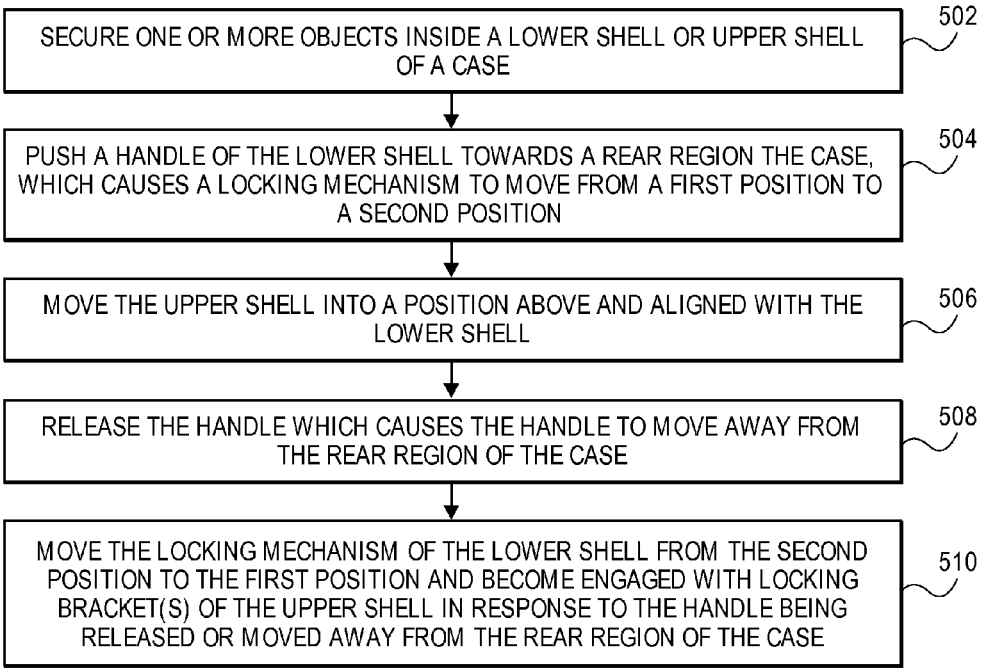
FIG. 5 illustrates a method for operating a multifunctional case having a locking mechanism in accordance with one embodiment.

FIG. 5 illustrates a method for operating a multifunctional case having a locking mechanism in accordance with one embodiment. At block 502, the method includes securing one or more objects, weapons, firearms, etc. inside a lower shell or upper shell of the multifunctional case. Adjustable width clip rails may be utilized for securing the one or more objects, weapons, firearms or other items in the case. At block 504, the method includes pushing a handle of the lower shell towards a rear region of the multifunctional case that is near a hinge of the case, which causes a locking mechanism to move from a first position to a second position. At block 506, an upper shell is moved by being tilted into a position above and aligned with the lower shell. At block 508, the handle is released or moved away from the rear region of the multifunctional case (or moved towards a front region of the case). At block 510, the locking mechanism of the lower shell moves from the second position to the first position and becomes engaged with locking bracket (s) of the upper shell in response to the handle being released or moved away from the rear region of the multifunctional case. The lower and upper shells of the firearm case are now locked together with no external clips or latches. In another embodiment, the firearm case also includes no padlocks, or key locking devices. Alternatively, the multifunctional case may include a padlock or key locking device such as the lock 140 of FIG. 1.

Figure 6:
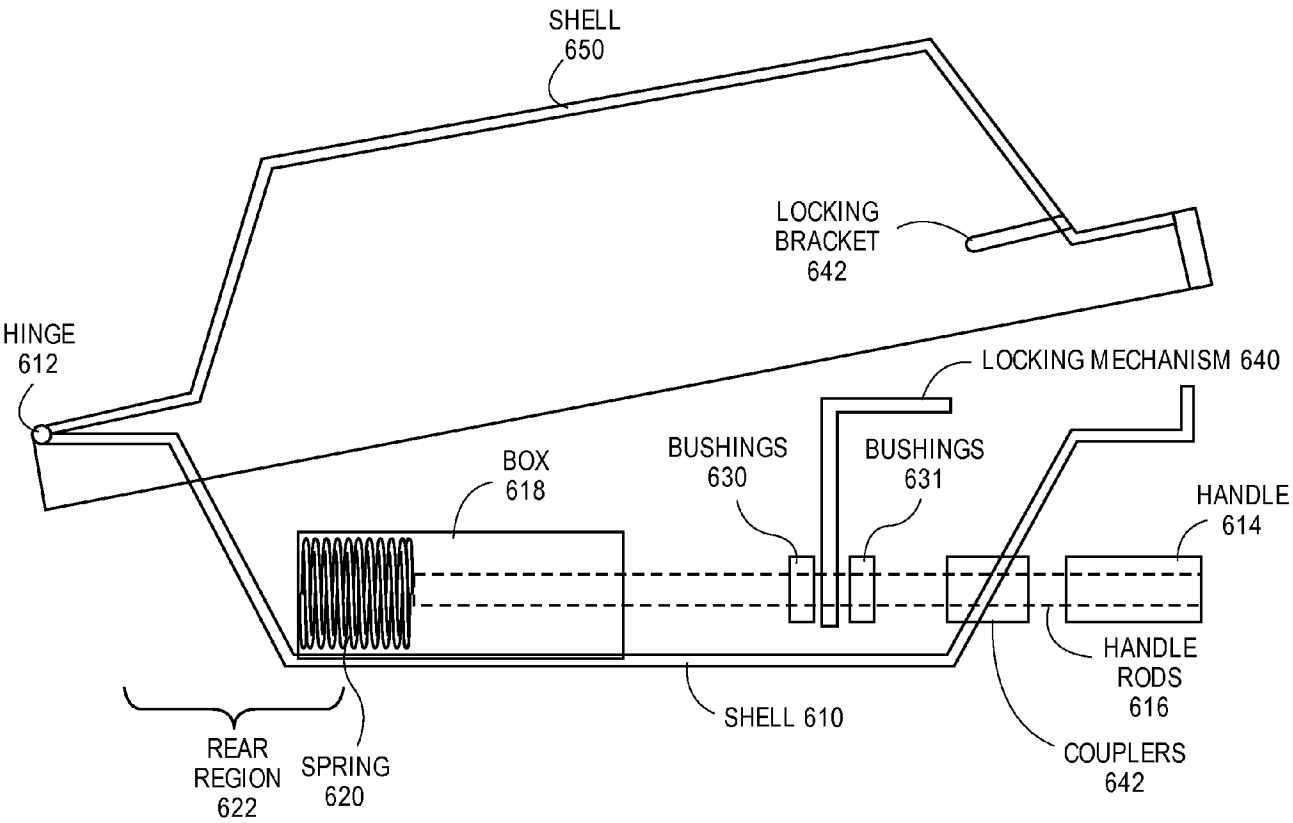
FIG. 6 illustrates a multifunctional case having a locking mechanism in accordance with one embodiment.
Figure 7:
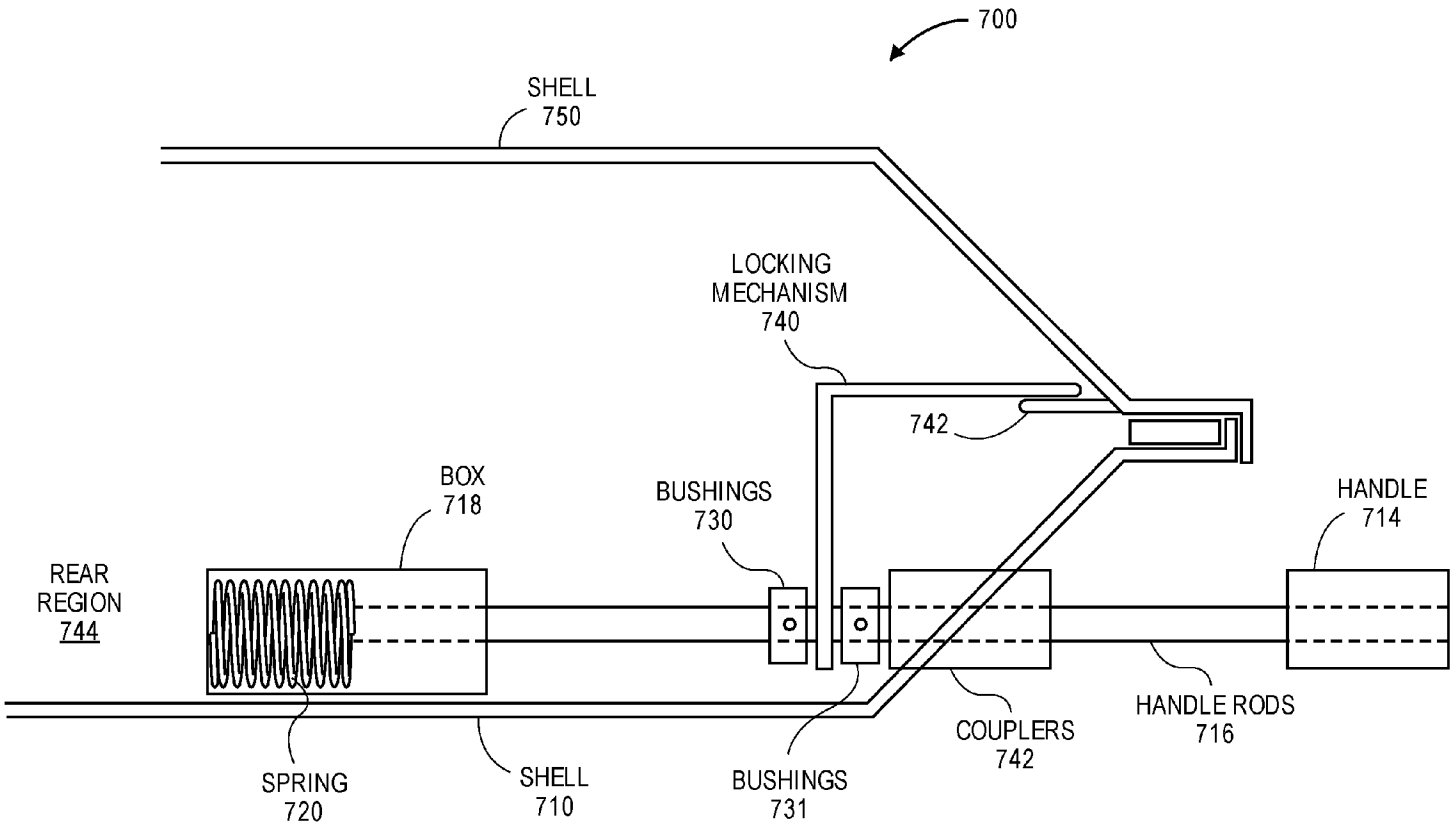
FIG. 7 illustrates a multifunctional case having a locking mechanism in accordance with one embodiment.

FIGS. 2, 6, and 7 collectively illustrate different positions of the handle and locking mechanism. FIG. 2 illustrates an open position in which a user can place one or more firearms, ammunition, or other items in the shell 210. The handle 214 is in the first position (e.g., released position).

FIG. 6 illustrates a multifunctional case having a locking mechanism in accordance with one embodiment. The multifunctional case 600 includes a shell 610 (e.g., lower or bottom shell) and a shell 650 (e.g., upper or top shell) that are coupled with a hinge 612. A handle 614 is mechanically coupled to handle rods 616, which are coupled to bushings 630, 631 (e.g., set screw bushings) and a spring 620. The spring is enclosed in box 618. A locking mechanism 640 (e.g., angle locking mechanism) moves based on movement of the handle towards a rear region 622 of the case or away from the rear region 622 of the case. FIG. 6 illustrates the handle 614 in a second position with the spring 620 being compressed. The locking mechanism 640 engages with the locking bracket 642 to lock the shells 610 and 650 or the locking mechanism 640 disengages from the locking bracket 642 to unlock the shells 610 and 650 based on the movement of the handle 614. The shell 610 also includes a clip side rail and an adjustable width clip rail for securing different types and sizes of objects, weapons, firearms, or other items within the case. The case may include additional springs, boxes, locking brackets, bushings, couplers, and handle rods that are not shown in FIG. 6.

FIG. 7 illustrates a multifunctional case having a locking mechanism in accordance with one embodiment. The multifunctional case 700 includes a shell 710 (e.g., lower or bottom shell) and a shell 750 (e.g., upper or top shell) that are coupled with a hinge (not shown). A handle 714 is mechanically coupled to handle rods 716, which are coupled to bushings 730, 731 (e.g., set screw bushings) and a spring 720. The spring is enclosed in box 718. A locking mechanism 740 (e.g., angle locking mechanism) moves based on movement of the handle and locking mechanism towards a rear region 744 of the case or away from the rear region 744 of the case. FIG. 7 illustrates the handle 714 in a first position (e.g., released position) with the spring 720 being uncompressed. The locking mechanism 740 engages with the locking bracket 742 to lock the shells 710 and 750 as illustrated in FIG. 7. The shell 710 also includes a clip side rail and an adjustable width clip rail for securing different types and sizes of firearms within the firearm case. The firearm may include additional springs, boxes, locking brackets, bushings, couplers, and handle rods that are not shown in FIG. 7.

Figure 8:
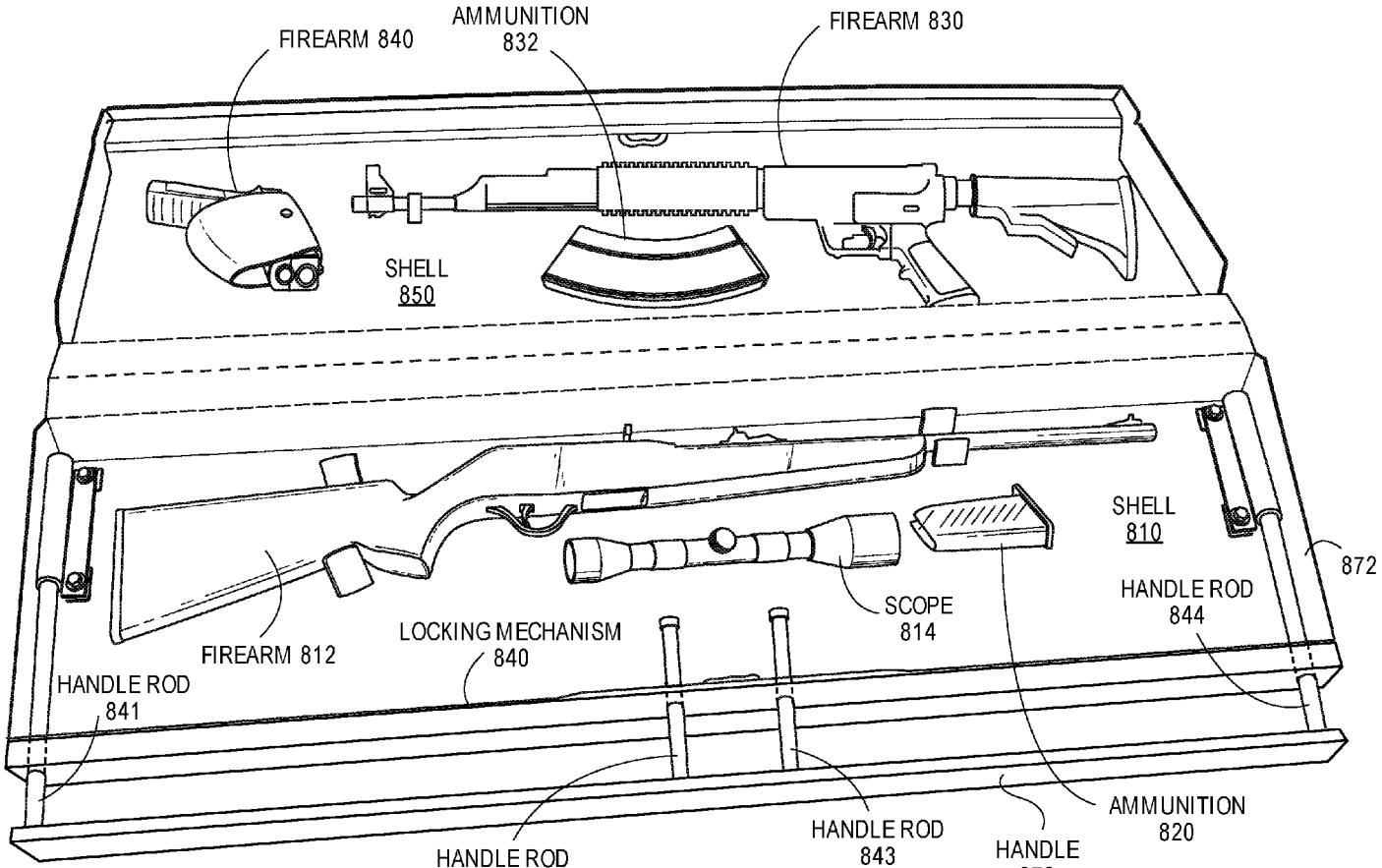
FIG. 8 illustrates a multifunctional case with different types of firearms in accordance with one embodiment.

FIG. 8 illustrates a multifunctional case having different types of firearms in accordance with one embodiment. The multifunctional case 800 includes a shell 810 (e.g., lower or bottom shell) and a shell 850 (e.g., upper or top shell) that are coupled with a hinge (not shown). The shell 810 includes a locking mechanism 840 and different types of clip rails for securing firearm 812, scope 814, and ammunition 820 to the shell 810. The shell 850 includes different types of clip rails for securing firearms 830, 840, and ammunition 832 to the shell 850. Other types of items (e.g., flashlight, sleeping bag, etc.) can also be secured to either shell. The shell 810 also includes a locking mechanism 840, handle rods 841-844, and a handle 870 for locking or unlocking the multifunctional case.

The shells of a multifunctional case described and illustrated in the present application generally have a hexagonal shape. In other embodiments, these shells may individually or in combination have any kind of geometrical shape including a polygon, a rectangular, a square, a quadrilateral, a pentagon, an octagon, etc. In certain embodiments, these shells overlap each other when in a closed position. In other embodiments, these shells have no overlap or minimal overlap when in a closed position.

Figure 9:
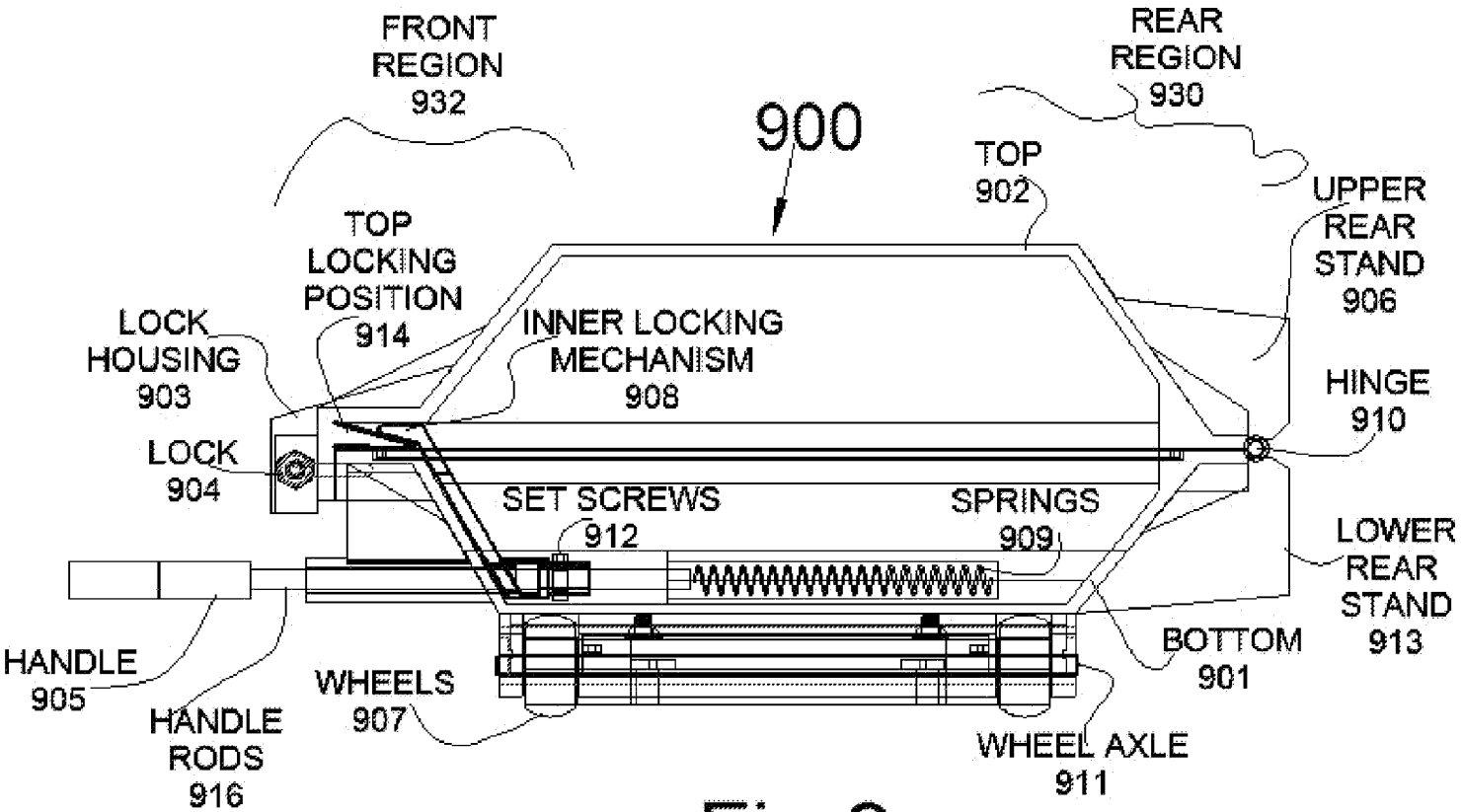
FIG. 9 illustrates a side view of shells of a multifunctional case in accordance with one embodiment.

FIG. 9 illustrates a side view of shells of a multifunctional case in accordance with one embodiment. A shell 901 (e.g., lower or bottom shell) includes similar components in comparison to the shell 210 of FIG. 2. The shell includes a hinge 910 (e.g., piano hinge, hinge shaft, hinge rod) for being coupled with a shell 902 (e.g., upper or top shell). An inner locking mechanism 908 can be engaged based on movement of the handle 905 to lock the shells together or disengaged for opening the case 900 and separating the shells. A handle 905 is mechanically coupled to handle rods 916, which are coupled to set screws 912, and springs 900. The springs may be enclosed in a box, which is attached to the shell 901. The set screws 912 secure a lower portion of the inner locking mechanism 908 to handle rods 916 and an upper portion of the inner locking mechanism 908 is engaged in a top locked position 914 when the shells are locked. The top locked position 914 is shaped like a wedge or crevice in FIG. 9 but can have any shape or size for locking with an upper portion of the inner locking mechanism 908.

Rear stands including an upper rear stand 906 and a lower rear stand 913 are coupled to a rear region 930 of the shells near the hinge 910. The rear stands provide a level support for when the case is positioned with a rear region 930 in a lower position and a front region 932 in an upper region such that the rear stands can be placed on a flat surface (e.g., ground) and supporting the case in an upright position. A lock housing 903 forms a housing for optional lock 904. The case can be transported on wheels 907 which are coupled to wheel shaft 911. The shells may include additional springs, boxes, locking brackets, bushings, couplers, and handle rods that are not shown in FIG. 9.

Figure 10:
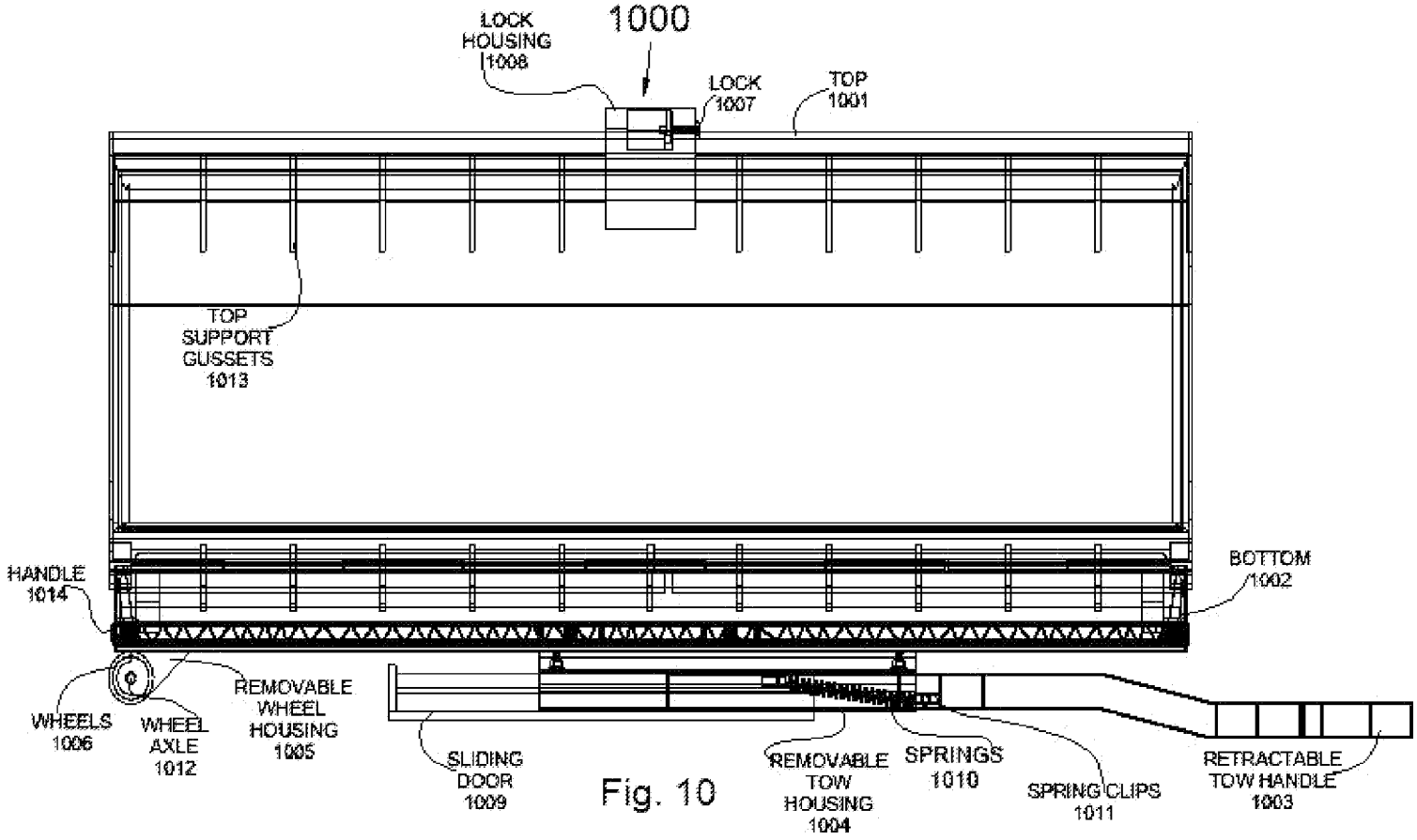
FIG. 10 illustrates an isometric view of a multifunctional case having a locking mechanism and a retractable tow handle in accordance with one embodiment.

FIG. 10 illustrates an isometric view of a multifunctional case having a locking mechanism and a retractable tow handle in accordance with one embodiment. The multifunctional case 1000 includes a shell 1002 (e.g., lower or bottom shell) and a shell 1001 (e.g., upper or top shell) that are coupled with a hinge. A retractable tow handle 1003 is mechanically coupled to spring clips 1011 which are coupled to springs 1010. A removable tow housing forms a housing for a sliding door 1009, the springs, spring clips, and retractable tow handle. A sliding door 1009 provides access for optionally storing one or more objects or items in a compartment of the tow housing or for accessing the springs 1010. A removable wheel housing 1005 is coupled to the shell 1002. The removable wheel housing 1005 forms a housing for wheels 1006 and wheel shaft 1012. The removable wheel housing 1005 can be removed from the bottom shell 1002 if desired. Top support gussets 1013 provide structural support for the shell 1001. A lock housing 1008 and lock 1007 are coupled or integrated with the upper or top shell 1001.

Figure 11:
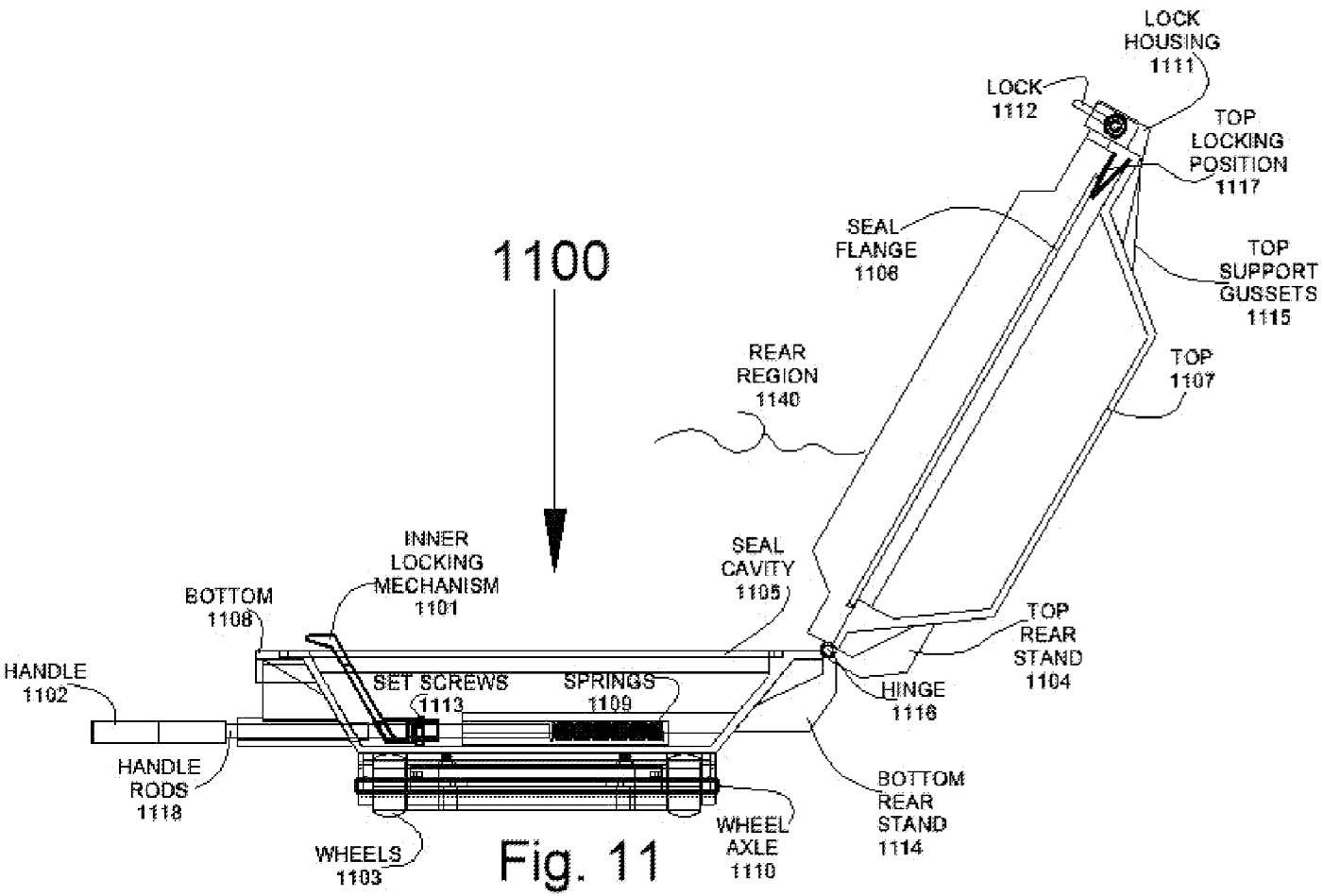
FIG. 11 illustrates a side view of shells of a multifunctional case in accordance with one embodiment.

FIG. 11 illustrates a side view of shells of a multifunctional case in accordance with one embodiment. A shell 1108 (e.g., lower or bottom shell) includes similar components in comparison to the shell 901 of FIG. 9. The shell includes a hinge 1116 (e.g., piano hinge, hinge shaft, hinge rod) for being coupled with a shell 1107 (e.g., upper or top shell). An inner locking mechanism 1101 can be engaged based on movement of the handle 1102 and the inner locking mechanism towards a rear region 1140 to lock the shells together or disengaged for opening the case 1100 and separating the shells. A handle 1102 is mechanically coupled to handle rods 1118, which are coupled to set screws 1113, and springs 1109. The springs may be enclosed in a box, which is attached to the shell 1108. The set screws 1113 secure a lower portion of the inner locking mechanism 1101 to handle rods 1118 and an upper portion of the inner locking mechanism 1101 is engaged in a top locking position 1117 when the shells are locked. The top locking position 1117 is shaped like a wedge or crevice in FIG. 11 but can have any shape or size for locking with an upper portion of the inner locking mechanism 1101.

Rear stands 1104 including top rear stands 1104 and bottom rear stands 1114 are coupled to a rear region 1140 of the shells near the hinge 1116. A lock housing 1111 forms a housing for optional lock 1112. The case can be transported on wheels 1103 which are coupled to wheel shaft (axle) 1110. Top support gussets 1115 provide structural support for the top shell 1107. The shells may include additional springs, boxes, locking brackets, bushings, couplers, and handle rods that are not shown in FIG. 11.

Figure 12:
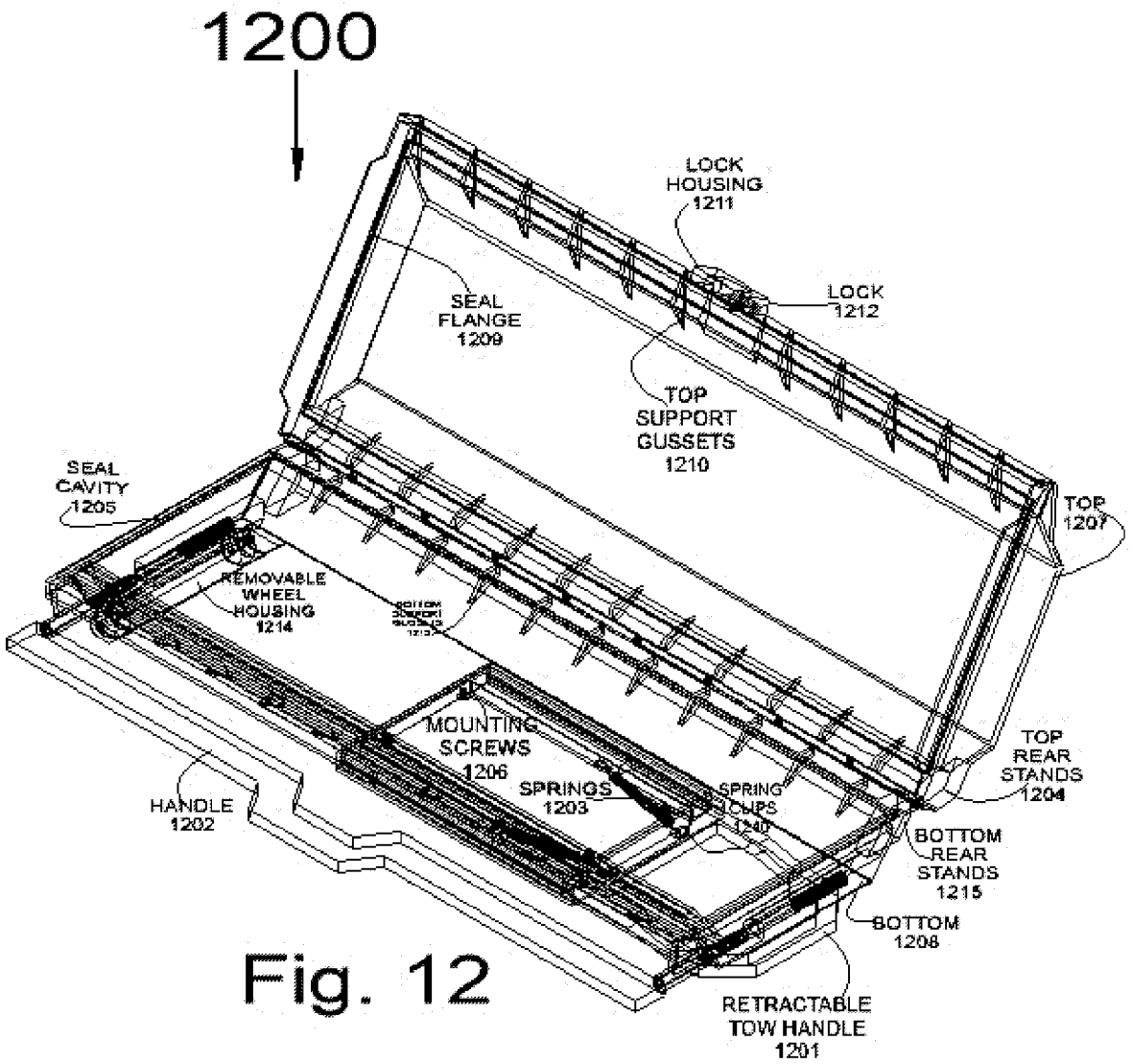
FIG. 12 illustrates a view of shells of a multifunctional case in accordance with one embodiment.

FIG. 12 illustrates a view of shells of a multifunctional case in accordance with one embodiment. A shell 1208 (e.g., lower or bottom shell) includes similar components in comparison to the shell 901 of FIG. 9 and the shell 1108 of FIG. 11. The shell includes a hinge (e.g., piano hinge, hinge shaft, hinge rod) for being coupled with a shell 1207 (e.g., upper or top shell). An inner locking mechanism can be engaged based on movement of the handle 1202 to lock the shells together or disengaged for opening the case 1200 and separating the shells. A handle 1202 is mechanically coupled to handle rods, which are coupled to set screws, and springs. Mounting screws 1206 couple a support for the springs to the shell 1208. The shell 1208 includes a seal cavity 1205 and the shell 1207 includes a seal flange 1209 for providing a weather proof seal for the shells when engaged and locked together. A retractable tow handle 1201 is mechanically coupled to spring clips 1240 which are coupled to springs 1203. Support gussets including top support gussets 1210 and bottom support gussets 1213 provide structural support for the shells 1207 and 1208, respectively.

Rear stands including top rear stand 1204 and bottom rear stand 1215 are coupled to one side of the shells near the hinge. A lock housing 1211 forms a housing for optional lock 1212. The shells may include additional springs, boxes, locking brackets, bushings, couplers, and handle rods that are not shown in FIG. 12.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A multifunctional protective rigid case, comprising:
- a first shell to secure at least one weapon;
- a hinge coupled to the first shell;
- a second shell coupled to the hinge, the first shell and second shell in combination form the multifunctional protective rigid case, wherein the second shell includes a plurality of locking brackets;
- a locking mechanism positioned within the first shell to engage with the plurality of locking brackets in a closed position; and
- an external handle that is coupled to handle rods which are coupled to the locking mechanism and causes the locking mechanism to lock and unlock the first and second shells of the multifunctional case based on movement of the external handle, wherein the handle rods extend outwardly from the first shell being partially visible outside the first shell and the external handle encloses one end of the handle rods, wherein the external handle defines a handle for carrying the multifunctional case, wherein the external handle has a length that extends along nearly an entire length of the first shell.

2. The multifunctional protective rigid case of claim 1, wherein the multifunctional protective rigid case is securely locked with no external clips or latches.

3. The multifunctional protective rigid case of claim 1, wherein the multifunctional protective rigid case includes an additional locking mechanism including an integrated rotary dial lock.

4. The multifunctional protective rigid case of claim 1, wherein the external handle is mechanically coupled to the handle rods, which are mechanically coupled to the locking mechanism and springs within the first shell.

5. The multifunctional protective rigid case of claim 4, wherein the external handle has a length that is similar to a length of the first shell.

6. The multifunctional protective rigid case of claim 5, wherein the locking mechanism disengages from the locking brackets to unlock the first and second shells based on the movement of the external handle.

7. The multifunctional protective rigid case of claim 1, wherein the locking mechanism includes an angle locking mechanism to engage with locking brackets of the second shell to lock the first and second shells.

8. The multifunctional protective rigid case of claim 7, further comprising:
- a biometric unit to receive a biometric input from a user and to allow the locking mechanism to be unlocked if the biometric input matches a previously stored biometric input.

9. The multifunctional protective rigid case of claim 7, wherein the angle locking mechanism is positioned near a front region of the first shell.

10. A case, comprising:
- a first shell formed of a rigid material;
- a second shell formed of the rigid material;
- a hinge to couple the second shell to the first shell;
- handle rods coupled to the first shell;
- an inner locking mechanism having a lower portion secured to the handle rods with screws; and
- a handle that is coupled to the handle rods which are coupled to the locking mechanism and causes an upper portion of the inner locking mechanism to engage with a wedge shaped locking position of the second shell to lock the first and second shells of the case together or to disengage with the wedge shaped locking position of the second shell to unlock the first and second shells based on movement of the handle, wherein the handle rods extend outwardly from the first shell being partially visible and the handle encloses one end of the handle rods, wherein the handle is coupled to the first shell for carrying the case.

11. The case of claim 10, wherein the locking mechanism moves or tilts based on movement of the handle towards a rear region of the case or away from rear region of the case.

12. The case of claim 11, wherein the handle in a first released position causes a spring coupled to the first shell to be decompressed and the first and second shells to be locked together with the locking mechanism engaging with the locking position of the second shell.

13. The case of claim 11, wherein the handle in a second position causes a spring coupled to the first shell to be compressed and the first and second shells to be unlocked with the locking mechanism disengaging from the locking position of the second shell.

14. The case of claim 11, wherein the case is configured to store, securely position, and protect weapons or firearms from theft and weather elements, wherein the handle has a length that extends along nearly an entire length of the first shell.

15. The case of claim 11, further comprising:
- a removable wheel housing having wheels.

16. A method for operating a multifunctional protective rigid case comprising:
- pushing an external handle, which is coupled to handle rods which are coupled to a locking mechanism, of a lower shell of the multifunctional protective rigid case towards a rear region of the multifunctional protective rigid case that is near a hinge of the multifunctional protective rigid case to cause the locking mechanism to move from a first position to a second position;

moving an upper shell of the multifunctional protective rigid case into a position above and aligned with the lower shell that is designed to secure at least one weapon;

releasing or moving the external handle away from the rear region of the protective rigid multifunctional case; and moving the locking mechanism from the second position to the first position of the case and engaging the locking mechanism with a plurality of locking brackets of the upper shell in response to the external handle being released or moved away from the rear region of the multifunctional protective rigid case that is near the hinge, wherein the handle rods extend outwardly from the lower shell being partially visible outside the lower shell and the external handle encloses one end of the handle rods, wherein the external handle is coupled to the lower shell for carrying the multifunctional protective rigid case, wherein the external handle has a length that extends along nearly an entire length of the lower shell.

17. The method of claim 16, further comprising:

securing one or more firearms inside the lower shell or upper shell of the multifunctional protective rigid case.

18. The method of claim 16, wherein the lower and upper shells of the multifunctional protective rigid case are locked together with the locking mechanism in the first position with the lower and upper shells having no external clips or latches.

* * * * *